United States Patent [19]

Linde et al.

[11] 4,266,389

[45] May 12, 1981

[54] METHOD AND AN ARRANGEMENT FOR THE ADVANCING OF A PACKING MATERIAL WEB THROUGH A PACKING MACHINE

[75] Inventors: Björn H. Linde, Lund, Sweden; Wilhelm Reil, Bensheim-Auerbach, Fed. Rep. of Germany

[73] Assignee: Tetra Pak International AB, Lund, Sweden

[21] Appl. No.: 964,623

[22] Filed: Nov. 29, 1978

[30] Foreign Application Priority Data

Nov. 29, 1977 [SE] Sweden ..... 7713491

[51] Int. Cl.[3] ..... B65B 41/12; B65B 41/14

[52] U.S. Cl. ..... 53/396; 53/451; 53/551; 53/389; 226/112; 226/114

[58] Field of Search ..... 53/396, 451, 551, 568, 53/389; 226/112, 114, 118, 149

[56] References Cited

U.S. PATENT DOCUMENTS

| | | | |
|---|---|---|---|
| 1,261,310 | 4/1918 | Smith | 83/604 |
| 2,814,676 | 11/1957 | House | 242/190 |
| 3,061,989 | 11/1962 | Newell et al. | 53/389 X |
| 3,081,014 | 3/1963 | Anderson et al. | 226/114 X |
| 3,776,441 | 12/1973 | Forthman, Jr. | 226/114 |
| 4,011,708 | 3/1977 | Brown, Jr. | 226/114 |
| 4,033,092 | 7/1977 | Vetter | 53/131 X |

*Primary Examiner*—John Sipos

*Attorney, Agent, or Firm*—Burns, Doane, Swecker & Mathis

[57] ABSTRACT

Packing machines for the manufacture of packing containers frequently produce these from web-like material, which is supplied to the machine in the form of a roll. During the production the material web is advanced through the machine along a path defined by guiding rollers, guiding rails and similar elements. These guiding elements obstruct in an undesirable manner the movement of the material web through the machine. This difficulty is eliminated in accordance with the invention in that a front and a back part of the material web are advanced alternately. In accordance with the invention, moreover, an arrangement is proposed with first and second web-advancing elements, which operate with alternating working strokes.

10 Claims, 1 Drawing Figure

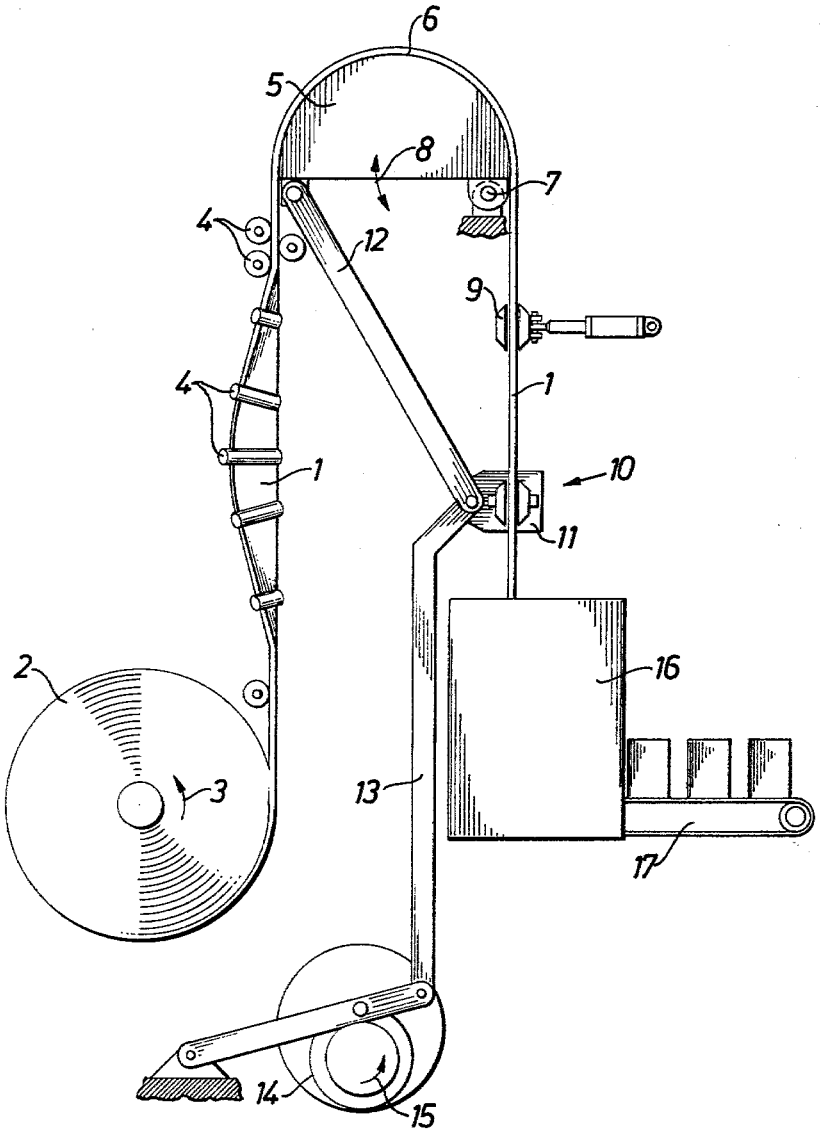
6
5
8
7
4
12
9
4
1
1
10
11
16
2
3
13
17
14
15

METHOD AND AN ARRANGEMENT FOR THE ADVANCING OF A PACKING MATERIAL WEB THROUGH A PACKING MACHINE

The present invention relates to a method for the advancing of a packing material web through a packing machine and an arrangement for the realization of the method on a packing machine for the manufacture of packing containers from a continuous packing material web.

A large number of modern packages of various types are manufactured at present from web-like starting material, supplied in the form of a roll to the packing machine, which subsequently ensures the advance of the packing material web through the machine, whilst successively converting it to packages of the desired type and size. In certain machines the filling and closing of the packages also takes place, so that the packages are completely finished when they leave the machine.

Typical examples of such machines are those which are generally used for the packing of liquid food, such as e.g. milk or juices, in parallelepipedic packages which are manufactured from web-like, laminated material. When filled packages are manufactured in such a machine, the web-like material is supplied to the machine in the form of a roll which is placed so that it can freely rotate in a so-called roll-rack in the lower part of the machine. From the roll-rack the packing material web is fed vertically upwards through the machine whilst it is doubled along its longitudinal centre line with the help of guiding rollers and similar elements. When the packing material web has reached the upper end of the machine the doubling is completed and it is then, in doubled condition, deflected about 180° with the help of a reversing element, so that it subsequently travels substantially downwards through the machine. During the downwards movement through the machine, in the first place, a sealing of the doubled web is carried out, so that the web obtains the shape of a tube, which is then successively filled with contents. The tubular material web filled with contents then reaches the forming device of the packing machine where, with the help of sealing jaws, the tube is sealed at regular intervals along zones extending transversely across the tube and through which zones the tube is later cut to produce separate cushion-like packing containers. As a result of subsequent shaping, the cushion-like packing containers are converted to parallelepipedic shape, and they are then discharged from the packing machine to be placed into collective containers and taken to the consumers.

It will be evident that the packing material on its path through a packing machine of the type described comes into contact with a number of machine parts and elements which in an undesirable manner exercize a braking action on the movement of the material web. This is particularly true of the guide rollers and elements which jointly convert the web to tubular shape and guide it right through the machine. In spite of advanced technical solutions and extensive efforts at reducing the friction and brake effect of these parts on the material, the total resistance becomes so great, that problems concerning the advance of the material arise, which express themselves through damage to the material web, e.g. stretching and similar effects which not only harm the strength of the material, but also bring about register problems, inasmuch as the direction pattern of the material web may fail to appear in the right place on the finished packing containers.

It is an object of the present invention to provide a method which would eliminate the abovementioned disadvantages and make possible an unobstructed progress of the packing material web through the packing machine.

This object has been achieved in accordance with the invention in that a method for the advancing of a packing material web through a packing machine in accordance with the invention has been given the characteristic that a front and a back part of the packing material web are advanced alternately. In this way the resistance on advancement of the front part of the packing material is reduced, so that its negative effect in the shaping of the packing containers becomes negligible.

A preferred embodiment of the method in accordance with the invention has been given the further characteristic that during the advancing of the back part of the web a surplus of material is produced which is consumed in the subsequent advancing of the front part of the web. Consequently the advancing of the front part of the web can take place wholly without influence from the back part of the web.

A further embodiment of the method in accordance with the invention has been given the further characteristic that the one part of the web is held stationary during the advancing of the other part of the web.

A further embodiment of the method in accordance with the invention has been given the further characteristic that the back part of the web is advanced in that its path through the packing machine is temporarily lengthened at the same time as the front part of the web is held stationary. In this manner the said material surplus "between the parts of the web" is produced which surplus can be consumed later without appreciable friction when the front part of the web is advanced.

A further embodiment of the method in accordance with the invention finally has been given the characteristic that the length of web advanced at each advancement corresponds to a length needed for a packing container. By adapting the length of each advance so that it corresponds to the material length which is consumed in the manufacture of a packing container, optimum accuracy and register holding is obtained.

It is a further object of the present invention to provide an arrangement for the realization of the abovementioned method.

An arrangement for the realization of the method in a packing machine for the manufacture of packing containers from a continuous packing material web has therefore been given the characteristic in accordance with the invention that it comprises reciprocating web-advancing elements, namely a first web-advancing element for the front part of the web and a second web-advancing element for the back part of the web, a working stroke of the first web-advancing element corresponding to a return stroke of the second web-advancing element and vice versa.

A preferred embodiment of the arrangement in accordance with the invention has been given the further characteristic that the second web-advancing element is in the form of a reversing element over which the web passes and which element is displaceable in working and return strokes, as a result of which the path of the material web through the packing machine is caused to be lengthened or shortened respectively, a web-retaining device being provided for holding the front part of the web stationary during the working stroke of the element. This construction provides a safe and accurate advance of the second part of the web and solves at the same time the problem of the previous large resistance to advance at the point where the web with the help of the reversing element is deflected about 180°.

A further embodiment of the arrangement in accordance with the invention has been given the further characteristic that the web-retaining device is arranged between the first and the second web-advancing element.

A further embodiment of the arrangement in accordance with the invention has finally been given the characteristic that the first and the second web-advancing element are mechanically joined together and are driven by a common power source, which ensures an accurately defined, alternating bringing about of the advancing of the two web parts.

The method and the arrangement in accordance with the invention will be described in detail in the following with special reference to the enclosed schematic drawing which illustrates the principle of the invention. The drawing on the whole only shows the parts in a known packing machine which are required for the realization of the method and the arrangement in accordance with the invention, and remaining parts of the machine have in general been completely omitted. However, these parts, like the packing machine as a whole, may be of conventional construction, well-known to those versed in the art, so that a more thorough description is not required.

It is evident from the drawing how a packing material web 1 runs vertically upwards from a material roll 2, supported so that it is freely rotatable, the direction of rotation of which during the operation of the machine is indicated by an arrow 3. The material web 1 proceeds on its path upwards through the machine past a number of guiding and manipulating rollers 4 which jointly bring about a doubling of the material web along the longitudinal centre line of the web. The doubling is completed when the material web reaches the upper part of the machine, where it passes over a reversing element 5 with a semicircular guiding surface 6 which makes possible a deflection of the packing material web about 180°, so that it subsequently proceeds substantially downwards through the machine. The reversing element 5, which also serves as a second web-advancing element, is suspended so that it can swivel about a horizontal axle 7 to make possible a swivelling, reciprocating movement indicated by the arrow 8. The material web 1 passes following the reversing element 6 a stationary web-retaining element 9 which with the help of two co-operting jaws alternately retains the packing material web and allows it to pass freely, respectively. A first web-advancing element 10 is also provided with two jaws which alternately retain and not retain the packing material web positioned between them. The jaws are carried by a plate 11 which can be linearly displaced upwards and downwards along guides, not shown in the drawing. The first web-advancing element 10 is joined to the second web-advancing element 5 by means of a link 12. The first web-advancing element 10 is connected moreover via a further link 13 with a cam disk 14, which, when rotating in the direction of the arrow 15, imparts via intermediate elements a vertically reciprocting movement to the link 13.

The packing material web on its path downwards through the machine passes a delivery pipe for contents, which extends between longitudinal edges of the packing material web resting against one another but not yet sealed together. The material web then passes a unit (not shown) for the sealing of the longitudinal edges, so that the material web is converted to a liquid-tight tube which is filled with contents by means of the delivery pipe. Finally, the material web 1 reaches a forming unit 16, which comprises elements (not shown) for the transverse sealing of the tube along transverse sealing zones situated at equal distances from one another, elements for the cutting up of the tube in the said sealing zones and elements for the converting of the cushion-shaped packages so obtained to the desired parallelepipedic shape. The finished packing containers are then discharged with the help of a conventional conveyor 17 from the machine, to be packed in collective containers and passed on to storage or consumer.

The advancing of the material web in the machine described takes place with the help of the first web-advancing element 10 and the second web-advancing element 5. More particularly, during operation of the machine, the driving shaft, on which the cam disk 14 is fixed, rotates thus imparting a vertically reciprocating movement to the link 13. This movement is transmitted to the first web advancing element 10, which, steered along the said guides, is displaced vertically upwards and downwards along the material web. The co-operating jaws of the web-advancing element 10 are driven at the same time with the help of e.g. a pneumatic or hydraulic cylinder unit in such a manner that the jaws are pressed towards one another and retain the packing material web 1 situated between them during the downward movement of the advancing element, whilst the jaws are separated from one another so that the material web 1 is freed when the web-advancing element is displaced upwards.

The movement of the web-advancing element 10 is transmitted via the link 12 to the lefthand part (on the drawing) of the second web-advancing element or reversing element 5, which in its turn is given an upwards and downwards swivelling movement about its support 7, which movement is indicated by means of the arrow 8. When the second web-advancing element 5 is displaced upwards, it will lengthen the path of the packing material web 1, which has the result that packing material web is delivered from the roll 2 and is moved upwards towards the second web-advancing element 5. To ensure that the already advanced front part of the web is not pulled back, use is made of the web-retaining device 9 which at the time of the upwards movement of the second web-advancing element 5 retains the front part of the packing material web between its jaws. The jaws of the web-retaining device 9 are actuated appropriately by a pneumatic or hydraulic piston and cylinder unit.

When the link 13, and with it also the link 12, are driven downwards by the cam disc 14, the second web-advancing element 5 swivels backwards again to the position shown on the drawing. Because of the inertia of the guiding and manipulating rollers 4, the back part of the packing material web, seen on the lefthand side on the drawing, does not slide downwards, but a surplus of material is formed along the curved guiding surface of the second web-advancing element 5, which surplus, however, is consumed by the very fact that the front part of the packing material web is fed downwards through the machine by the first web-advancing element, whose jaws have been closed at the start of the downwards movement of the element. This advancing of the front part of the material web can now take place practically without any resistance, since the surplus of web material is utilized, and the advancing is not influenced by the friction in the guiding and manipulating rollers 4, and the resistance, which is the result of the doubling of the back part of the web and the rolling off from the material roll. Thus the stretching of the web is reduced and an appreciable increase in the accuracy of feed becomes possible, which ensures that the decoration pattern of the web will be in its correct position on the finished packing containers.

Although the method and the arrangement in accordance with the invention have been described in the foregoing in connection with a specific, known type of packing machine, it is of course possible to apply the invention also to other types of packing machines, whose construction differs appreciably from that described. The essential point is only that the principle of the invention is made use of, that is to say that the web is divided into an appropriate front and back part, which are advanced each by itself and alternately, so that during the advancing of the back part of the web a surplus of material is produced, which is used in the subsequent advancing of the front part of the web. Owing to only one part of the web being advanced at a time, the friction and stress on the critical front part of the web, which is the part mainly involved in the package formation, can be kept to a minimum. The advancing of the back part of the web does not have to take place by lengthening or shortening its path through the packing machine, but the advancing can instead take place with the help of e.g. a further advancing element of the same type as the first web-advancing element 10.

If the length of packing material advanced at each advancement corresponds to the length of packing material which is consumed for the formation of a packing container, the advancing elements and shaping elements can operate synchronously, which further increases the accuracy and moreover facilitates the driving of the unit.

The driving of the advancing elements can be done in the manner most suitable in conjunction with the packing machine, e.g. by mechanical, pneumatic, hydraulic or electrical means.

By the pivotable suspension of the combined reversing and advancing element 5 at its far end (seen in the direction of feed of the web), a pattern of movement is imparted to the same which causes the sliding of the material web against the guiding surface 6 of the element 5 to be limited to the time when the advancing of the front part of the web takes place, that is to say the time when the element carries out its return movement and when the part of the web resting against the element is unstressed. By this any unnecessary braking of the web through friction between the guiding surface 6 and the material is avoided.

When the element 5 during its working movement is displaced upwards and consequently advances the back part of the web, the web, owing to the resistance of the said part of the web against advancement, will rest against the guiding surface 6 of the element 5. During this advancing movement, however, the web rests against the guiding surface of the element 5 without any relative movement taking place between surface and web, and the contact therefore does not involve any disadvantage.

The element 5 provided with the curved guiding surface 6 can of course be substituted by e.g. a movable roller or reversing cylinder, but this has the disadvantage that if it is made with the same radius as the element 5, which is desirable for the careful handling of delicate material webs, it will take up twice as much room, thus causing considerable difficulties in modern packing machines of compact design.

We claim:

1. A method for advancing a packing material web in a packing machine comprising the steps of:

clamping the material web at a first location;

pivoting a curved surface about a fixed pivot against a first portion of the packing material web without sequential sliding between said web and said curved surface, said pivot being positioned substantially at one end of said surface, the first portion being rearward, in a machine direction, with respect to the first location, to advance the first portion of the packing material web;

clamping the material web at a second location, said second location being forward, in a machine direction, with respect to the first location;

releasing said material web at the first location;

pivoting said curved surface about said pivot away from the first portion, said web being under substantially less tension than during said first mentioned pivoting step and a substantial portion of said curved surface being out of the path of said web to substantially minimize frictional damage to the web caused by sliding contact between the web and the curved surface; and urging said clamped material web at the second location forward in a machine direction toward a package forming unit.

2. The method of claim 1 wherein the curved surface is pivoted away from the first portion while simultaneously urging the clamped material web at the second location forward toward a said package forming unit.

3. The method of claim 1 wherein the material web clamped at the second location is advanced while the advancement of the first portion is interrupted.

4. The method of claim 1 further comprising the step of repeatedly interrupting the advancement toward said unit of the packing material web clamped at the second location, the first portion and the material web clamped at the second location being advanced alternately.

5. An apparatus for advancing a packing material web in a packing machine, comprising:

first means for advancing a first portion of a web, said first means including an arcuate surface which is pivotable about a fixed pivot positioned substantially at one end of said surface;

second means for advancing a second portion of the web, the second means being forward, in a machine direction, with respect to the first means, said second means including mean for moving the second means in a reciprocating motion along a defined path to thereby feed said second web portion;

means for intermittently clamping the material web at a location between said first and second portions; and a lever, connecting said second means to the arcuate surface, said lever being arranged to pivot the arcuate surface about the fixed pivot when the second means moves to alternately advance the first and second portions of the web.

6. The apparatus of claim 5 wherein the pivotable, arcuate surface selectively pivots into engagement with the first portion of the web.

7. The apparatus of claim 6 wherein the pivotable, arcuate surface is arranged to move between a working pivoting stroke and a return pivoting stroke, the working stroke of the second means occurring during the return pivoting stroke of the arcuate surface.

8. The apparatus of claim 5 wherein said lever is operable to urge said arcuate surface to pivot about said fixed pivot in response to a motion of said second means along said defined path.

9. A method for advancing a packing material web in a packing machine, comprising the steps of:

guiding the web in a looped path over a reversing element having an arcuate surface and then to a package forming unit;

clamping the web intermittently between said reversing element and said package forming unit;

pivoting the arcuate surface of the reversing element intermittently in a first direction about a fixed pivot and against the web without substantial sliding between said web and said arcuate surface, said pivot being positioned substantially at one end of the surface, to increase the length of the looped path, said pivoting step and said clamping step occurring simultaneously; and subsequently releasing the clamped web while substantially at the same time pivoting the arcuate surface of the reversing element about said pivot in a second direction away from the looped path, said web being under substantially less tension than during said first mentioned pivoting step and a substantial portion of said arcuate surface being out of the path of said web to substantially minimize frictional damage to the web caused by sliding contact between the web and the arcuate surface, while gripping the portion of said web between said reversing element and said package forming unit and moving said gripped portion to advance the web in a direction toward said unit.

10. A method for advancing a packing material web in a packing machine comprising the steps of:

clamping the material web at a first location;

pivoting a curved surface of a first means for engaging the web about a fixed pivot and against a first portion of the packing material web to thereby advance said portion by moving a first end of a lever in a first direction, a second end of which lever is connected to said curved surface of said first means for engaging the web, and said first end being connected to a second means for engaging the web, said pivot being positioned substantially at one end of said surface, and the first portion being rearward, in a machine direction, with respect to the first location, to advance the first portion of the packing material web;

clamping the material web with said second means at a second location, said second location being forward, in a machine direction, with respect to the first location;

releasing said material web at the first location;

pivoting said curved surface away from the first portion by moving said first end of said lever in a second direction; and urging said clamped material web at the second location forward in a machine direction with said second means toward a package forming unit.

* * * * *